US006696884B1

(12) United States Patent
Seven

(10) Patent No.: US 6,696,884 B1
(45) Date of Patent: Feb. 24, 2004

(54) METHOD AND APPARATUS TO ACHIEVE LONG TIME CONSTANTS WITH A SMALL MOS GATE CAPACITOR

(75) Inventor: Kazim Seven, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/316,302

(22) Filed: Dec. 10, 2002

(51) Int. Cl.[7] ..... G05F 3/01

(52) U.S. Cl. ..... 327/540; 327/543; 327/552; 327/554; 327/91; 327/94; 327/95

(58) Field of Search ..... 327/540, 541, 327/543, 552–556, 91, 93–96, 337, 148, 157; 330/305, 306, 9; 323/313, 310

(56) References Cited

U.S. PATENT DOCUMENTS 4,365,204 A * 12/1982 Haque ..... 327/337
5,148,054 A * 9/1992 Demler ..... 327/91
5,225,836 A * 7/1993 Morley et al. ..... 341/150
5,481,212 A * 1/1996 Shima ..... 327/94

OTHER PUBLICATIONS

"LM4819 350mW Audio Amplifier with Shutdown Mode," *National Semiconductor Corporation*, Apr. 2002, 1 pg.
"LM4901 1.6 Watt Audio Power Amplifier with Selectable Shutdown Logic Level," *National Semiconductor Corporation*, May 2002, 1 pg.
"LM4854. 1.9W Monaural, 85m W Stereo Headphone Audio Amplifier," *National Semiconductor Corporation*, May 2002, 2pgs.
"LM4890 1 Watt Audio Power Amplifier," *National Semiconductor Corporation*, Jul. 2002, 1 pg.

* cited by examiner

*Primary Examiner*—Timothy P. Callahan
*Assistant Examiner*—An T. Luu
(74) *Attorney, Agent, or Firm*—Brett A. Hertzberg; Merchant & Gould, P.C.

(57) ABSTRACT

A filtered reference voltage is provided with improved PSRR without the use of a large capacitor. First and second reference voltages are generated, where the reference voltages are centered about an input reference voltage. A first small valued capacitor circuit samples a selected one of the first and second reference voltages. The selected one is determined by the comparison between the filtered reference voltage and the input reference voltage. A second small valued capacitor circuit is periodically coupled to the first capacitor circuit such that charge redistribution occurs. The overall voltage on the second capacitor circuit is increased when the filtered reference voltage is less than the input reference voltage, or decreased when the filtered reference voltage is greater than the input reference voltage. The voltage from the second capacitor circuit is buffered to provide the filtered reference voltage. The overall system is suitable for an integrated circuit.

20 Claims, 8 Drawing Sheets

METHOD AND APPARATUS TO ACHIEVE LONG TIME CONSTANTS WITH A SMALL MOS GATE CAPACITOR

FIELD OF THE INVENTION

The present invention relates generally to a method and apparatus to eliminate the requirement of a large capacitor to achieve a long time constant in a system. More particularly, the present invention relates to generating long time constant in an integrated circuit where large capacitors are currently unfeasible.

BACKGROUND OF THE INVENTION

Low pass filters are employed in electronic circuit for a variety of reasons. A first order low pass filter is constructed simply of a resistor (R) in series with a capacitor (C) that is coupled to ground. An input signal (VIN) is applied to an input of the resistor, while an output is observed across the capacitor. The values associated with the R and C will determine the frequency and time domain response characteristics of the low pass filter.

The voltage across the capacitor (VC) provides an output signal that can be expressed by the time-domain equation $V_C(t)=V_{IN}*(1-e^{-t/\tau})$. At time t=0, voltage $V_C$ is initially equal to zero, while at time t=∞ voltage $V_C$ is observed as equal to $V_{IN}$. The term $\tau$ is referred to as the time constant for the time domain response. For the first order filter described above, $\tau$=RC. The frequency domain response of the low pass filter is described in terms of the corner frequency ($f_c$). The corner frequency corresponds to the −3 dB point in the frequency response of the filter. The corner frequency of a first order RC-type filter is given by 1/(RC) in units of radians/sec, or $1/(2\pi RC)$ in units of Hz. A lower corner frequency ($f_c$) is achieved by increasing the product of R and C, yielding a longer time constant.

One common application of a low pass filter is to minimize noise and ripple in a reference voltage. An ideal reference voltage is a purely DC signal. A non-ideal reference voltage is passed through a low pass filter to filter to remove undesirable high frequencies. Power supply noise or ripple is coupled through the capacitor to ground such that the high frequency components are eliminated in the output signal. However, in order to realize a more ideal reference voltage, the corner frequency of the low pass filter must be very low. In other words, the RC time constant associated with the first order low pass filter must be very long to provide a better reference voltage.

SUMMARY OF THE INVENTION

According to one example of the present invention, a switched-capacitor reference voltage circuit includes an offset generator circuit, five switching circuits, two capacitor circuits, and a buffer circuit. The offset generator circuit is configured to receive an input reference voltage from an input node. The offset generator circuit is configured to provide a first reference voltage at a first reference node and a second reference voltage at a second reference node. The first switching circuit is coupled between a first node and a second node, and includes a first control terminal that is configured to receive a first control signal. The second switching circuit is coupled between the second node and a third node, and includes a second control terminal that is configured to receive a second control signal. The third switching circuit is coupled between the input node and the second node, and includes a third control terminal that is configured to receive a third control signal. The fourth switching circuit is coupled between the first reference node and the first node, and includes a fourth control terminal that is configured to receive a fourth control signal. The fifth switching circuit is coupled between the second reference node and the first node, and includes a fifth control terminal that is configured to receive a fifth control signal. The first capacitor circuit is coupled to the second node. The second capacitor circuit is coupled to the third node. The buffer circuit is configured to periodically update a stored voltage at the third node, and arranged to provide a buffered reference signal in response to the stored voltage. The stored voltage corresponds to a filtered version of the input reference voltage.

According to a further feature, the offset generator circuit may be configured such that the first reference voltage is substantially 100 mV above the input reference voltage, and the second reference voltage is substantially 100 mV below the input reference voltage. The offset generator circuit may be further configured such that the first reference voltage and the second reference voltage are compensated for at least one of process and temperature related variations in the voltages. The offset generator circuit may include a unity gain amplifier that is biased such that currents in the unity gain amplifier are proportional to VBG/R, and the unity gain amplifier is configured to provide the first and second reference voltages by driving the proportional current through resistors.

According to another feature, the switching circuits may each include a p-type FET that is configured to operate as a switching circuit, wherein each p-type FET is further arranged to minimize leakage currents.

According to still another feature the capacitor circuits may correspond to n-type FETs that are configured to operate as gate-type capacitors. A first capacitance value that is associated with the first capacitor circuit may be less than a second capacitance value that is associated with the second capacitor circuit. The first and second capacitance circuits may be on-die capacitors.

According to yet another feature, the comparator circuit may be arranged to compare the input reference voltage to the buffered reference signal. The fourth and fifth control signals are responsive to the output of the comparator circuit such that the voltage associated with the second capacitor circuit is increased when the input reference voltage is greater than the buffered reference signal. The voltage associated with the second capacitor circuit is decreased when the input reference voltage is less than the buffered reference signal.

According to still yet another feature, a comparator circuit is arranged to compare the input reference voltage to the buffered reference signal. The fourth and fifth control signals are responsive to the output of the comparator circuit.

According to one example, a divider circuit may be configured to provide the input reference signal as a division of a power-supply voltage. A control logic circuit may be arranged to provide the control signals such that the buffered reference signal is substantially the same as the input reference signal. A clock generator circuit may be configured to provide a first and second clock signal in response to an input clock signal. The first clock signal is associated with a cycle time of the switched-capacitor reference voltage circuit. A control logic circuit may be arranged to generate pulse signals for each of the first, second, and third second control signals such that the first, second, and third switching circuits are activated at different times with respect to one another.

According to another embodiment of the invention, an apparatus provides for a filtered reference voltage. The apparatus includes a first means for storing charge that is arranged to store charge. A second means for storing charge is arranged to store charge. A means for buffering is arranged to provide a buffered reference signal in response to the charge that is stored in the second means for storing charge. A means for comparing is arranged to compare the buffered reference voltage and an input reference voltage. A means for generating offset voltage is arranged to provide a first reference voltage and a second reference voltage in response to the input reference voltage. The first reference voltage is greater than the input reference voltage by a first amount. The second reference voltage is less than the input reference voltage by a second amount. A first means for switching is arranged to periodically couple a selected one of the first and second reference voltages to the first means for storing charge during a first time interval. The selected one of the first and second reference voltages is determined by the means for comparing. A second means for switching is arranged to periodically couple the first means for storing charge to the second means for storing charge during a second time interval such that the charges stored in the first and second means for storing charge are redistributed during the second time interval.

According to a further aspect, a third means for switching is arranged to periodically couple the input reference voltage to the first means for storing charge during a third time interval that is different from the first and second time intervals such that charge leakage effects are minimized.

According to another embodiment, a method is related to providing an output reference voltage with improved PSRR. The method includes generating first and second reference voltages from an input reference voltage. The first reference voltage is greater than the input reference voltage by a first amount, and the second reference voltage is less than the input reference voltage by a second amount. The method also includes coupling the first input voltage to a first node when the output reference voltage is less than the input reference voltage by an amount, and coupling the second input voltage to the first node when the output reference voltage is greater than the input reference voltage by another amount. The method further includes storing charge associated with the voltage from the first node at a second node during a first time interval, and coupling the second node to a third node during a second time interval that is different from the first time interval. The method also includes redistributing charge during the second time interval such that the voltages associated with the second and third nodes are the same during the second time interval, storing charge associated with the voltage associated with the third node at the end of the second time interval, and buffering the voltage at the third node to provide the output reference voltage.

According to a further example, the first amount and the second amount are the same. The method may also include comparing the output reference voltage to the input reference voltage. The method could also include coupling the input reference voltage to the second node during a third time interval, wherein the third time interval is different from the first and second time intervals. The first, second, and third time intervals may be repeated at a regular interval, wherein the third time interval is substantially longer than the first and second time intervals.

A more complete appreciation of the present invention and its improvements can be obtained by reference to the accompanying drawings, which are briefly summarized below, the following detail description of presently preferred embodiments of the invention, and the appended claims.

DETAILED DESCRIPTION OF THE PREFERRED EMBODIMENTS

Throughout the specification, and in the claims, the term "connected" means a direct electrical connection between the things that are connected, without any intermediate devices. The term "coupled" means either a direct electrical connection between the things that are connected, or an indirect connection through one or more passive or active intermediary devices. The term "circuit" means either a single component or a multiplicity of components, either active or passive, that are coupled together to provide a desired function.

Long time constant circuits are difficult to construct in integrated circuits. An RC-type low pass filter circuit requires large values for R and C to achieve a long time constant. Resistor values that can be practically constructed on die are in the range up to 1MΩ before excessive leakage or other undesirable cost factors prevail. Assuming we required a time constant of one second, a 1MΩ resistor would require a capacitor with a value of 1 uF. However, on-die capacitors are typically in the range up to 100 pF and a 1 uF capacitor cannot be achieved on-die within an acceptable die-size and cost. Off-chip or external capacitors are employed to achieve long time constants since large on-die capacitors are impractical.

The present invention provides for a filtered reference voltage with improved PSRR without the use of a large capacitor. First and second reference voltages are generated, where the reference voltages are centered about an input reference voltage. A first small valued capacitor circuit samples a selected one of the first and second reference voltages. The selected one is determined by the comparison between the filtered reference voltage and the input reference voltage. A second small valued capacitor circuit is periodically coupled to the first capacitor circuit such that charge redistribution occurs. The overall voltage on the second capacitor circuit is increased when the filtered reference voltage is less than the input reference voltage, or decreased when the filtered reference voltage is greater than the input reference voltage. The voltage from the second capacitor circuit is buffered to provide the filtered reference voltage. The overall system is suitable for an integrated circuit.

Figure 1:
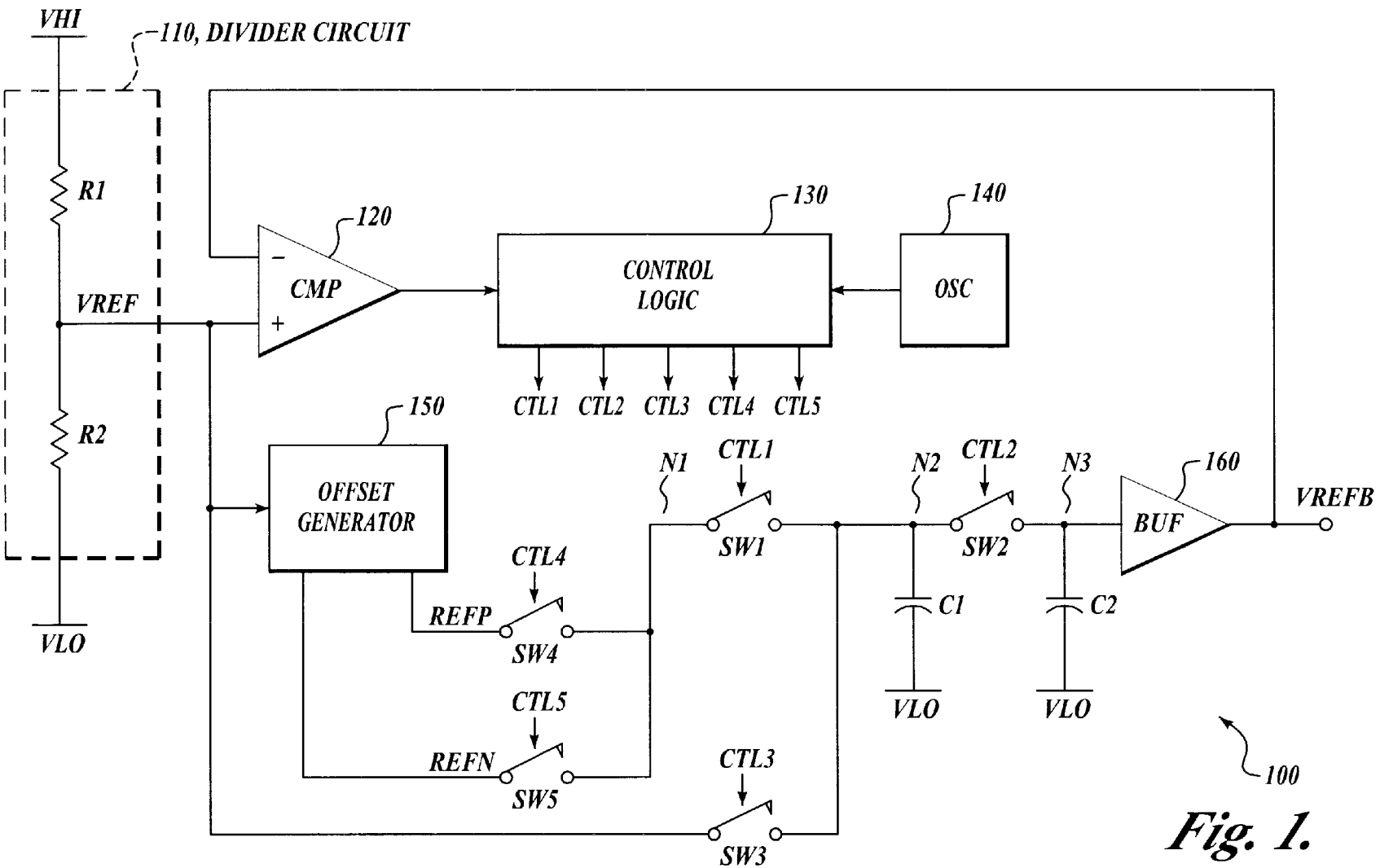
FIG. 1 is an example system that provides for a long time-constant.

FIG. 1 is an example system (100) that provides for a long time-constant in accordance with the present invention.

System 100 includes a divider circuit (110), a comparator circuit (120), a control logic circuit (130), a clock generator circuit (140), an offset generator circuit (150), five controlled switching circuits (SW1–SW5), two capacitor circuits (C1, C2), and buffer circuit (160).

Divider circuit 110 is arranged to provide a reference voltage (VREF) as a division of the power supply voltages (VHI, VLO). Comparator circuit 120 is arranged to compare the input reference signal (VREF) to an output reference signal (VREFB). The output of comparator circuit 120 is coupled to control logic circuit 130, which is arranged to provide control signals CTL1 through CTL5. Clock generator circuit 140 is arranged to provide one or more clocking signals to control logic circuit 130. Offset generator circuit 150 is arranged to provide first and second offset reference signals (REFP, REFN). The first offset reference signal corresponds to a positively offset reference signal with respect to VREF, while the second offset reference signal corresponds to a negatively offset reference signal with respect to VREF. Switching circuit SW4 is arranged to couple the first offset reference signal (REFP) to node N1 when actuated in response to control signal CTL4. Switching circuit SW5 is arranged to couple the second offset reference signal (REFN) to node N1 when actuated in response to control signal CTL5. Switching circuit SW1 is arranged to couple the signal from node N1 to node N2 when actuated in response to control signal CTL1. Switching circuit SW3 is arranged to couple the input reference signal (VREF) to node N2 when actuated in response to control signal CTL3. Switching circuit SW2 is arranged to couple the signal from node N2 to node N3 when actuated in response to control signal CTL2. Capacitor circuit C1 is coupled between node N2 and VLO, while capacitor circuit C2 is coupled between node N3 and VLO. Buffer circuit 160 is arranged to provide the output reference signal in response to the signal at node N5.

In operation, system 100 is arranged to operate as switched capacitor circuit that operates in a control loop. The main purpose of the control loop that is shown in system 100 is to control the voltage that is stored on capacitor C2. Buffer circuit 160 provides a buffered version of the voltage that is stored on capacitor C2. The output voltage (VREFB) that is provided by the buffer is compared to the input reference voltage (VREF) by comparator circuit 120. Control logic circuit 130 will assert either CTL4 or CTL5 depending on the output of comparator circuit 120. For example, control logic circuit 130 will assert the CTL5 signal when the input reference signal is lower than the output reference signal. Alternatively, control logic circuit 130 will assert the CTL4 signal.

The voltage at node N1 corresponds to REFP when the input reference signal (VREF) is less than the output reference signal (VREFB). The voltage at node N1 corresponds to REFN when the input reference signal (VREF) is greater than the output reference signal (VREFB). The amount of difference between VREF and VREFB depends on the minimum overdrive requirements and any offsets for comparator circuit 120.

Capacitor circuits C1 and C2 are of non-equal values according to a ratio such as 1 to 10. In one example, capacitor circuits C1 and C2 have values of 5 pF and 50 pF, respectively. Since 5 and 50 pF are well within the design limits of integrated circuit technology, the capacitors are easily provided as "on-die" capacitors.

The voltage stored on capacitor circuit C1 is always within the range of VREFP and VREFN, where VREF is the midpoint voltage between VREFP and VREFN. The input reference voltage (VREF) is periodically coupled to capacitor C1 circuit via switching circuit SW3. After capacitor circuit C1 is initialized (or reset) to VREF, switching circuit SW1 is periodically closed to charge capacitor circuit C1 to either VREFP or VREFN. Charge is transferred from capacitor circuit C1 to capacitor circuit C2 when switching circuit SW2 is closed. Since capacitor circuits C1 and C2 are of unequal values, the amount of charge transferred to capacitor circuit C2 is a gradual process.

In one example charging operation, capacitor circuit C2 is completely discharged to VLO. Switching circuit SW4 is closed since VREF is greater than VREFB, and capacitor circuit C1 is charged to REFP when switching circuit CTL1 closes. The charge stored (Q) on capacitor circuit C1 is given by Q=C1*REFP. According to charge conservation laws, charge is redistributed between capacitor circuits C1 and C2 when switching circuit SW2 is closed. Since capacitor circuits C1 and C2 are in parallel, the redistributed charge yields a final voltage (V) that is given by V=(C1*REFP)/(C1+C2), or V=REFP/(1+C2/C1). For a ratio of capacitors that are 10:1 as previously described, the final voltage at the end of the charge redistribution cycle is given as V=REFP/11, or V=(VREF+VOS)/11, which is approximated as V=0.09*(VREF+VOS).

In another example charging operation, the voltage stored on capacitor circuit C2 is initially greater than VREF. Switching circuit SW5 is closed since VREF is less than VREFB, and capacitor circuit C1 is charged to REFN when switching circuit CTL1 closes. The charge stored (Q1) on capacitor circuit C1 is given by Q1=C1*REFN, which corresponds to Q1=C1*(VREF−VOS). The charge stored (Q2) on capacitor C2 is give by Q2=C2*VREFB. According to charge conservation laws, charge is redistributed between capacitor circuits C1 and C2 when switching circuit SW2 is closed. Since capacitor circuits C1 and C2 are in parallel, the redistributed charge yields a final voltage (V) that is given by V=[C1*(VREF−VOS)/(C1+C2)]+[(C2*VREFB)/(C1+C2)]. For a ratio of capacitors that are 10:1 as previously described, the final voltage at the end of the charge redistribution cycle is simplified as V=[(VREF−VOS)/11)]+[VREFB/1.1], which is approximated as: V=0.09*VREF−0.09*VOS+0.9*VREFB.

In one example, VREFP is 100 mV above VREF and VREFN is 100 mV below VREF, and the ratio of the capacitors is 10:1 as previously described. For this example, the step size for changes in the voltage across the capacitors is approximately determined by 0.09*VOS=+/−9 mV.

Figure 2:
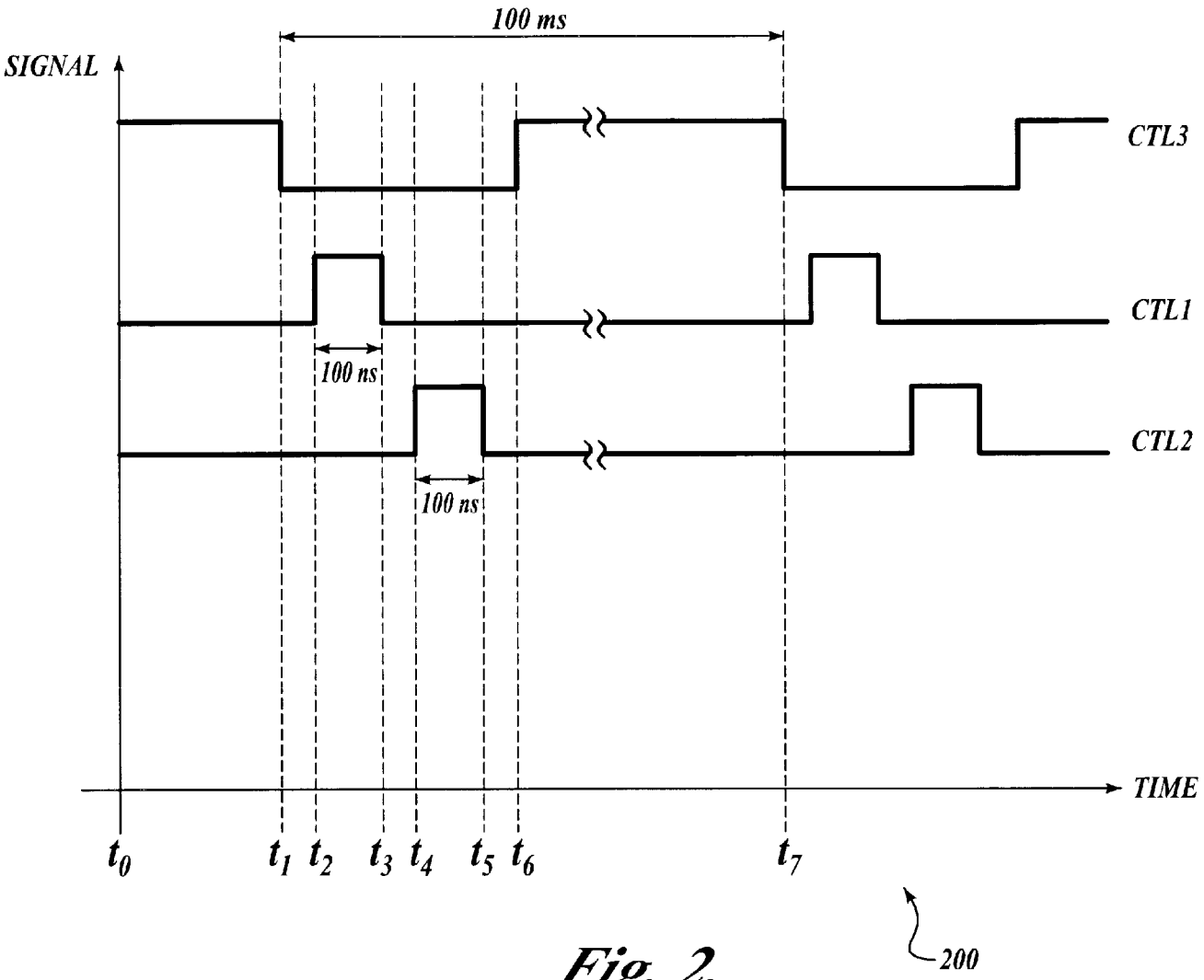
FIG. 2 is a waveform diagram that illustrates relative switching operations.

FIG. 2 is a waveform diagram that illustrates the relative switching operations of switching circuits SW1–SW3. Each of the switching circuits (SW1–SW5) has a corresponding control signal (CTL1–CTL5) such that each switching circuit is in a closed circuit configuration when asserted, and an open circuit configuration when not asserted.

Switching circuit SW3 is maintained in a closed position from time t0 through t1 such that the voltage associated with capacitor circuit C0 is maintained as VREF. At time t1, control signal CTL3 changes from a high logic level to a low logic level such that switching circuit SW3 is opened. At time t6, control signal CTL3 changed from a low logic level to a high logic level such that switching circuit SW3 is again closed. The switching operation of switching circuit SW3 has a period that is illustrated, for example, as a 100 mS time period between times t1 and t7.

Switching circuit SW1 is maintained in an open circuit position from time t0 until control signal CTL1 is asserted at time t2. Between times t2 and t3, control signal CTL1 is asserted such that capacitor circuit C1 is initialized, or reset, to REFP or REFN depending on the output of comparator circuit 120 as previously described. At time t3, control signal CTL1 changes from a high logic level to a low logic level and switching circuit SW1 is again maintained in an open circuit position until the next cycle. Switching circuit SW1 is in the closed circuit position for a time period that is defined by a pulse width. An example pulse width for operating switching circuit SW1 is illustrated in FIG. 2 as 100 nS. The pulse width is not critical, and need only be long enough to complete the charge transfer associated with capacitors C1 and C2.

Switching circuit SW2 is maintained in an open circuit position from ime t0 until control signal CTL2 is asserted at time t4. Between times t4 and t5, control signal CTL2 is asserted such that capacitor circuit C1 is coupled to capacitor circuit C2, and charge is transferred and redistributed between the capacitors. At time t5, control signal CTL2 changes from a high logic level to a low logic level and switching circuit SW2 is again maintained in an open circuit position until the next cycle. Switching circuit SW2 is in the closed circuit position for a time period that is defined by a pulse width. An example pulse width for operating switching circuit SW2 is illustrated in FIG. 2 as 100 nS.

Figure 3:
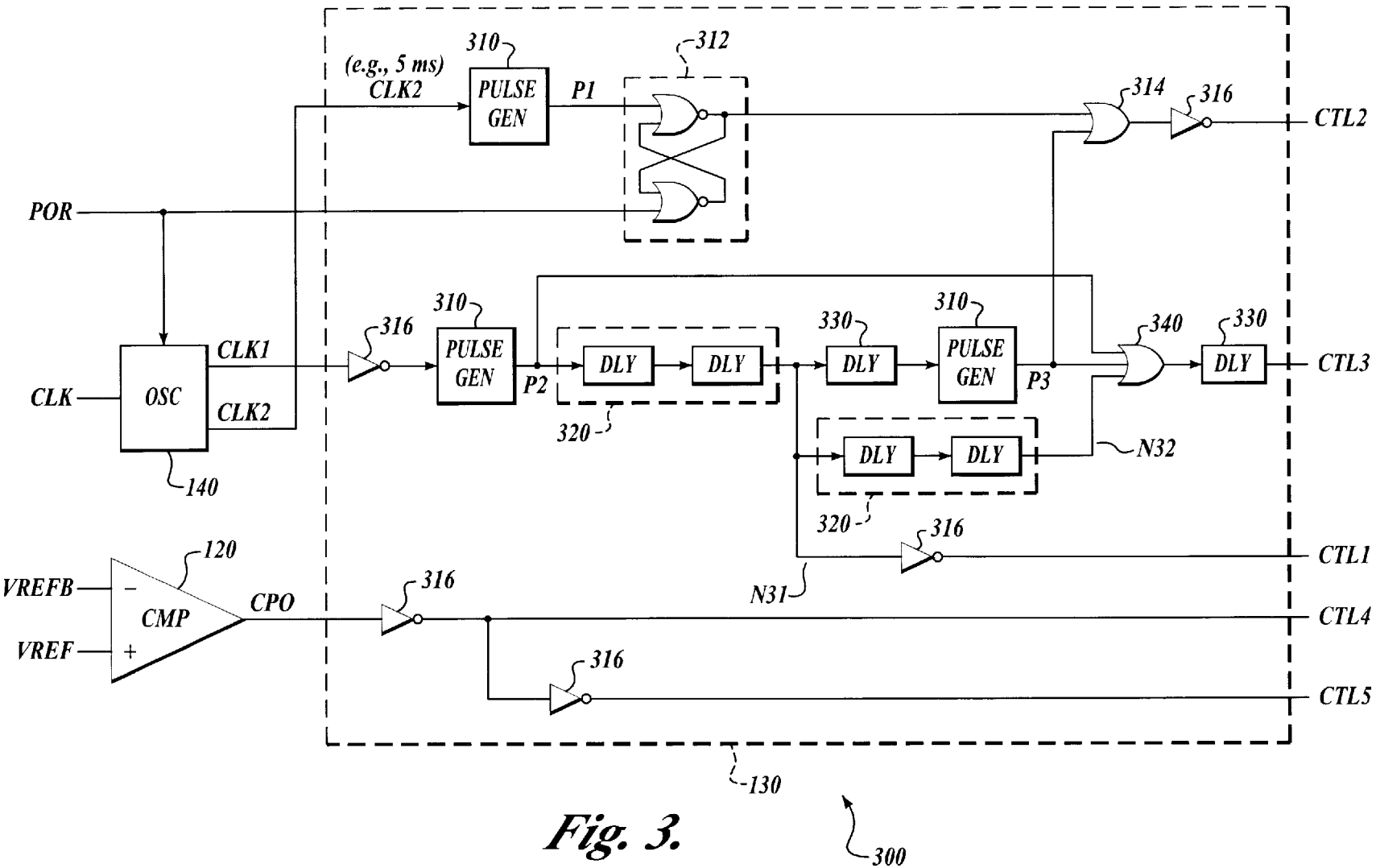
FIG. 3 is a schematic diagram that illustrates a detailed example implementation for a control logic circuit.

FIG. 3 is a schematic diagram (300) that illustrates a detailed example implementation for control logic circuit 130. The schematic diagram (300) includes comparator circuit 120, control logic circuit 130, and clock generator circuit 140. Control logic circuit 130 includes three pulse generator circuits (310), a latch circuit (312), a two input OR circuit (314), five inverter circuits (316), delay circuits (320, 330), and a three input OR circuit.

Clock generator circuit 140 is arranged to provide two clock signals (CLK1, CLK2) in response to an input clock signal (CLK) activated. A power-on-reset signal (POR) is included to reset the clock generator. The first clock signal (CLK1) has a period that is shorter than that of the second clock signal (CLK2). In one example, the first clock signal has a period of 5 mS, while the second clock signal has a period of 100 mS. In other words, the first clock signal has a frequency that is substantially higher than the frequency of the second clock signal (e.g., 200 Hz and 10 Hz). Comparator circuit 120 is responsive to signals VREF and VREFB, and provides an output signal that corresponds to CPO. Control logic circuit 130 is arranged to provide control signals CTL1–CTL5 in response to CLK1, CLK2, CPO, and POR.

The first pulse generator is arranged provide a first pulse signal (P1) to the latch circuit (312) in response to the second clock signal (CLK2). Latch circuit 312 is arranged to receive the POR signal and the first pulse signal (P1) such that latch circuit 312 is set by the first pulse signal. Two input OR circuit 314 receives a first input signal from the output of the latch, and a second input signal from the output of the third pulse generator circuit. The two input OR circuit (314) provides a logic signal to first inverter 316, which provide control signal CTL2. Second inverter 316 is arranged to invert the first clock signal (CLK1). Second pulse generator (310) is arranged to receive the inverse of the first clock signal and provide a second pulse signal (P2). First delay circuit 320 is arranged to provide a delayed version of the second pulse (P2) to node N31. First delay circuit 330 is arranged to provide a delayed version of the signal from node N31 to the third pulse generator (310), which is configured to provide the third pulse signal (P3). Second delay circuit 320 is arranged to provide delayed version of the signal from node N31 to node N32. Three input OR circuit 340 is arranged to provide a signal to second delay circuit 330 in response to the second and third pulse signals (P2, P3), and the signal from node N32. Second delay circuit 330 provides control signal CTL3. Third inverter circuit 316 is arranged to provide control signal CTL1 in response to the signal from node N31. Fourth inverter circuit 316 is arranged to provide control signal CTL4 in response to signal CPO, while fifth inverter 316 is arranged to provide control signal CTL5 in response to control signal CTL4.

Figure 4:
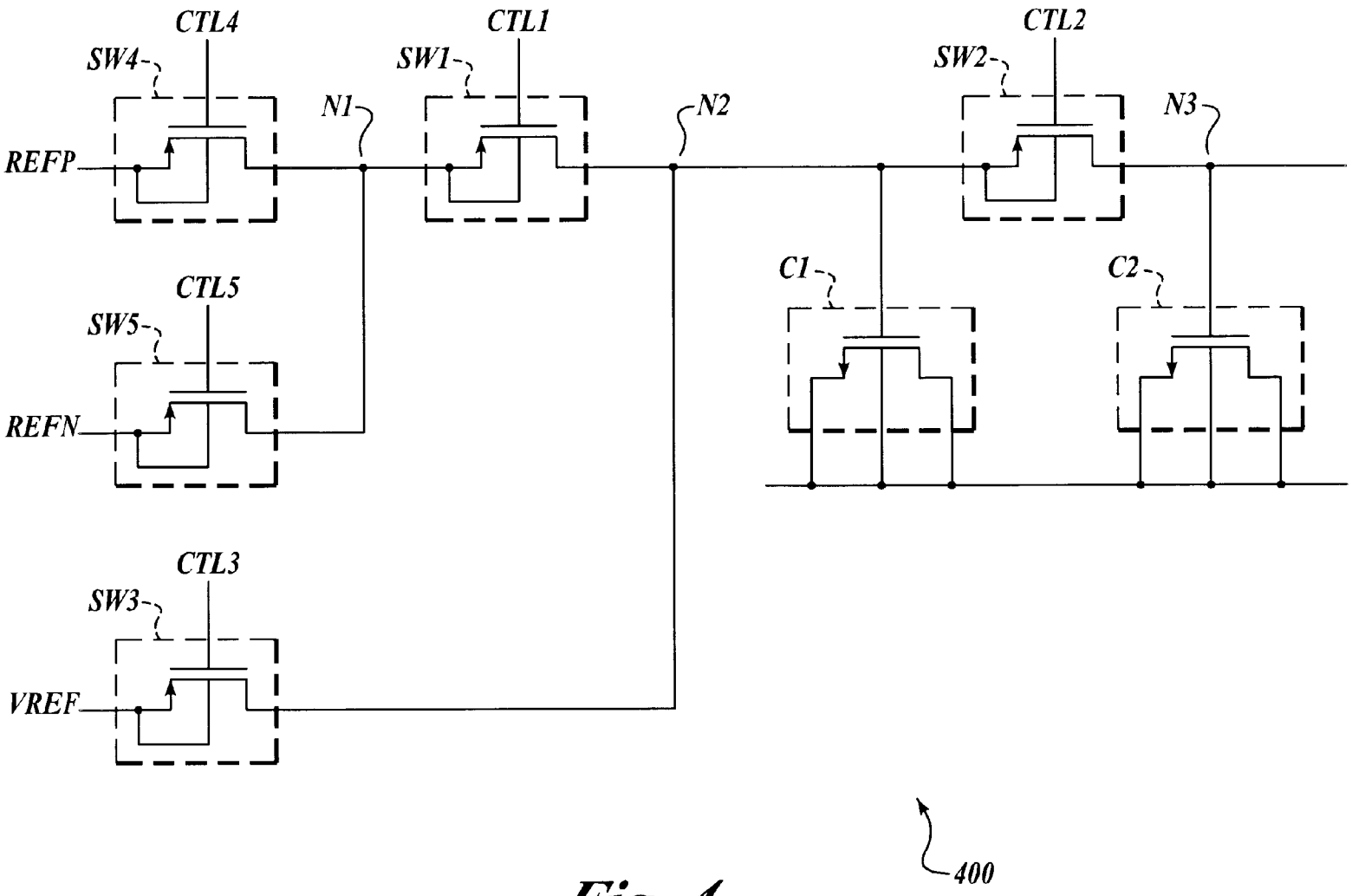
FIG. 4 is a schematic diagram illustrating a detailed example of switching circuits and capacitor circuits.

FIG. 4 is a schematic diagram (400) illustrating a detailed example of switching circuits SW1–SW5 and capacitor circuits C1 and C2 from system 100. Switching circuits SW1–SW5 are illustrated as p-type field effect transistors (PFETs). Each of the switching transistors is isolated from other circuits in their own well such that leakage effects are minimized. Capacitor circuits C1 and C2 are illustrated as gate-type capacitors using n-type field effect transistors (NFETs).

The well connections for the PFETs in switching circuits SW3–SW5 are coupled to their respective voltage source inputs (VREF, REFP, REFN). Charge leakages through the substrate are satisfied by the low impedance voltage sources such that the charges stored in capacitor circuits C1 and C2 are undisturbed by the charge leakage. The well connection for the PFET in switching circuit SW1 is coupled to either REFP or REFN via switching circuits SW4 and SW5 such that well leakage effects are minimized. The well connection for the PFET in switching circuit SW2 is coupled to node N2. At steady state operation, node N2 is maintained in the range from REFP to REFN and the total voltage variations on node N2 minimize leakage effects from switching circuit SW2.

Figure 5:
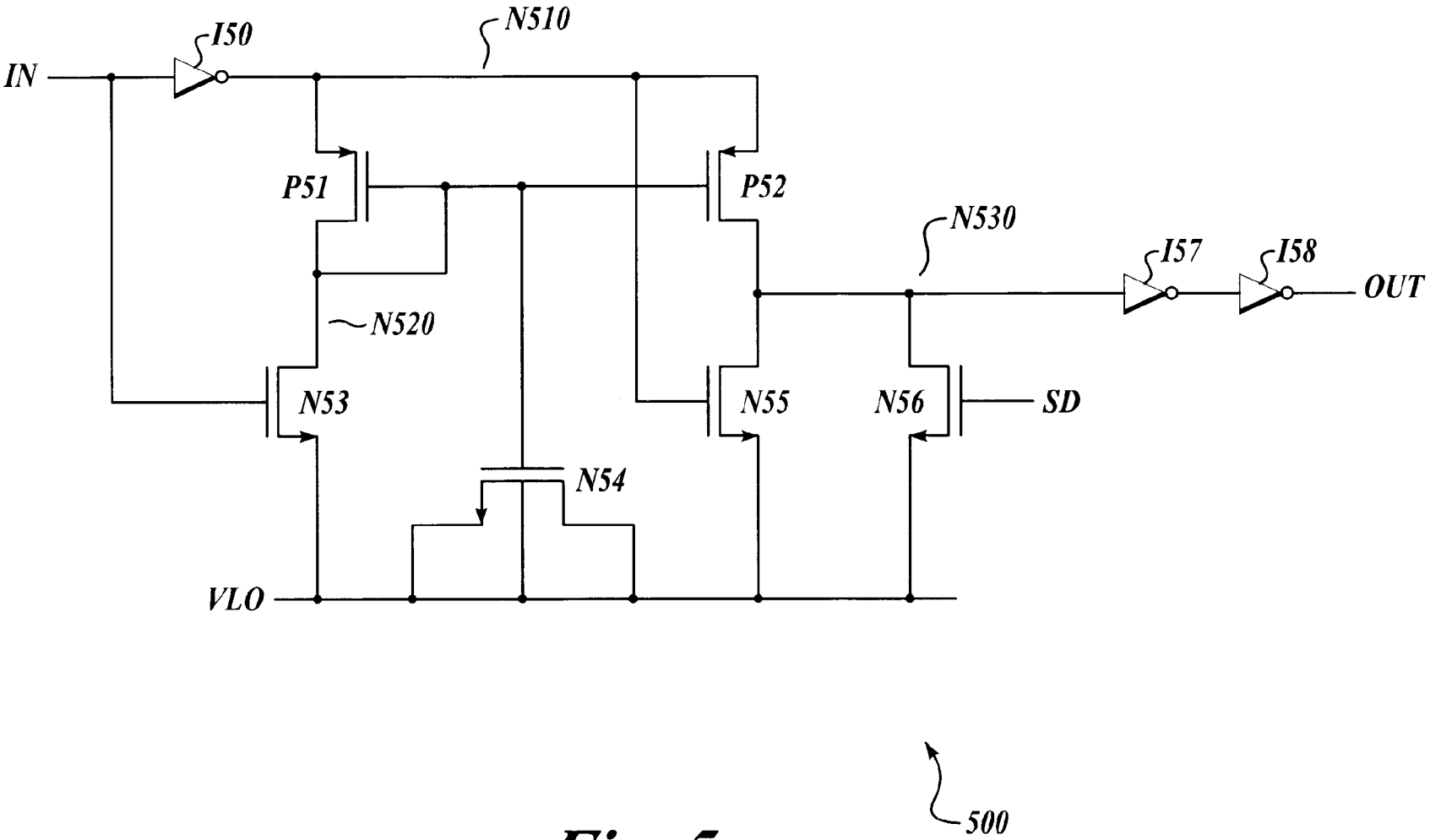
FIG. 5 is a schematic diagram illustrating a detailed example of a pulse generator circuit.

FIG. 5 is a schematic diagram illustrating a detailed example of a pulse generator circuit (500) that may be employed by the control logic circuit illustrated in FIG. 3. The pulse generator circuit (500) includes inverters I50, I57, I58; PFETs P51–P52; and NFETs N53–N56.

The pulse generator circuit is configured to provide a defined length output pulse at an output terminal (OUT) in response to an edge of an input signal at an input terminal (IN). Inverter I50 is arranged to provide an inverse of the input signal to node N510. Transistor P51 is a diode-connected device that is coupled between node N510 and node N520. Transistor N53 is arranged to couple node N520 to VLO when the input signal corresponds to a high logic level, and isolate node N520 from VLO when the input signal is a low logic level. Transistor N54 is configured as a capacitor that is coupled between node N520 and VLO. Transistor P52 is arranged to couple node N510 to node N530 when the signal sensed from node N520 substantially reaches a threshold associated with transistor P52. Transistor N55 is configured as a resistive load between node N530 and VLO that is activated when the signal at node N510 is a high logic level. Inverters I57 and I58 are series coupled between node N530 and the output terminal (OUT).

In operation, the pulse generator circuit (500) is responsive to a high-to-low edge transition in the input signal. The gate capacitance of transistor N54 is initially discharged to VLO via transistor N53. The input signal transitions to a low logic level, causing the signal at node N510 to begin changing from a low signal level to a high signal level. Transistor P51 forms a resistive path from node N510 to node N520. However, the signal level at node N520 cannot change instantaneously due to the gate capacitance of transistor N54. Transistor P52 becomes active while the voltage at node N520 is lower than the threshold voltage associated with transistor P52. Transistor N55 is highly resistive such that transistor P52 is sufficient to pull the potential at node N530 to a high-logic level, resulting in a high logic level output signal at the output terminal (OUT). Once the gate of transistor N54 charges to a sufficient level, transistor P52 is deactivated, and node N530 is pulled down to a low logic level via transistor N55. Thus, transistors P51 and N54 form an RC time constant circuit that defines a pulse width associated with the output of the pulse generator circuit (500).

Figure 6:
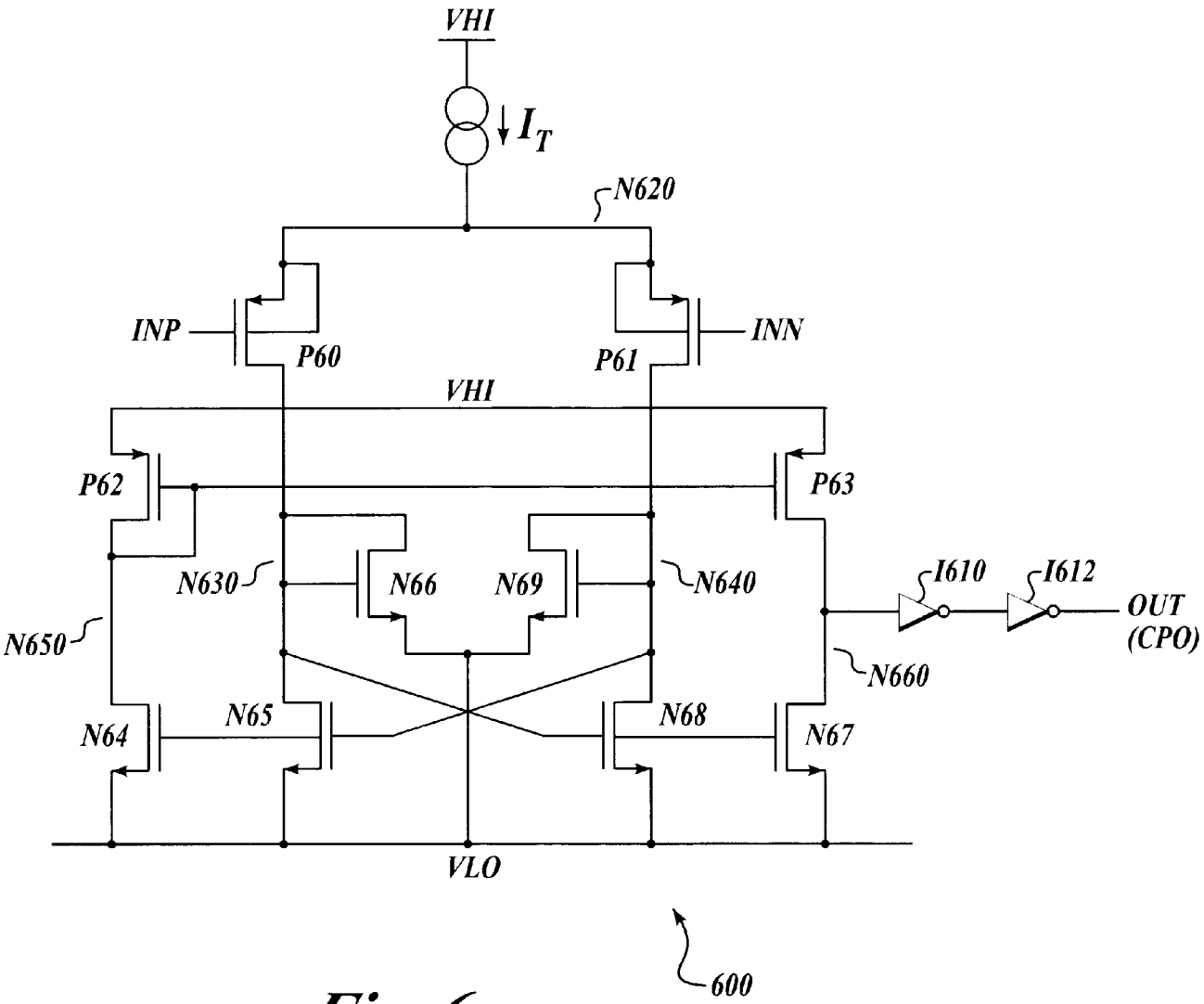
FIG. 6 is a schematic diagram illustrating a detailed example of a comparator circuit.

FIG. 6 is a schematic diagram illustrating a detailed example of a comparator circuit (600) that may be employed by the circuits illustrated in FIGS. 1 and 3. The comparator circuit (500) includes PFETs P60–P63, NFETs N64–N69, inverters I610–I612, and current source IT.

Current source IT is coupled to between VHI and node N62. Transistor P60 includes a source that is coupled to node N620, a gate that is coupled to INP, and a drain that is coupled to node N630. Transistor P61 includes a source that is coupled to node N620, a gate that is coupled to INN, and a drain that is coupled to node N640. Transistor P62 includes a source that is coupled to VHI, and a gate and drain that are coupled to node N650. Transistor P63 includes a source that is coupled to VHI, a gate that is coupled to node N650, and a drain that is coupled to node N660. Transistor N64 includes a source that is coupled to VLO, a gate that is coupled to node N640, and a drain that is coupled to node N650. Transistor N65 includes a source that is coupled to VLO, a gate that is coupled to node N640, and a drain that is coupled to node N630. Transistor N66 includes a source that is coupled to VLO, and a gate and drain that are coupled to node N630. Transistor N67 includes a source that is coupled to VLO, a gate that is coupled to node N630, and a drain that is coupled to node N660. Transistor N68 includes a source that is coupled to VLO, a gate that is coupled to node N630, and a drain that is coupled to node N640. Transistor N69 includes a source that is coupled to VLO, and a gate and drain that are coupled to node N640. Inverter circuits I610–I612 are series coupled between node N660 and the output terminal (OUT).

The comparator circuit is configured to provide an output signal at an output terminal (OUT) in response to a differential input signal that is applied across the input terminals (INP, INN). Node N660 is an intermediate output of the comparator. Inverters I610 and I612 add gain to the intermediate output to provide the output signal at the output terminal (OUT). Transistors P60 and P61 and current source IT form a differential pair that is responsive to signals from INP and INN. Transistor P60 conducts more current when INP is less than INN, while transistor P61 conducts more current when INN is less than INP. When transistor P60 takes more current than P61, the voltage associated with node N630 increases faster than the voltage associated with node N640, and transistor N68 becomes more active than transistor N65 such that node N660 is pulled down towards VLO. When transistor P61 takes more current than P60, the voltage associated with node N640 increases faster than the voltage associated with node N630, and transistor N65 becomes more active than transistor N68 such that node N660 is pulled down towards VHI.

Figure 7:
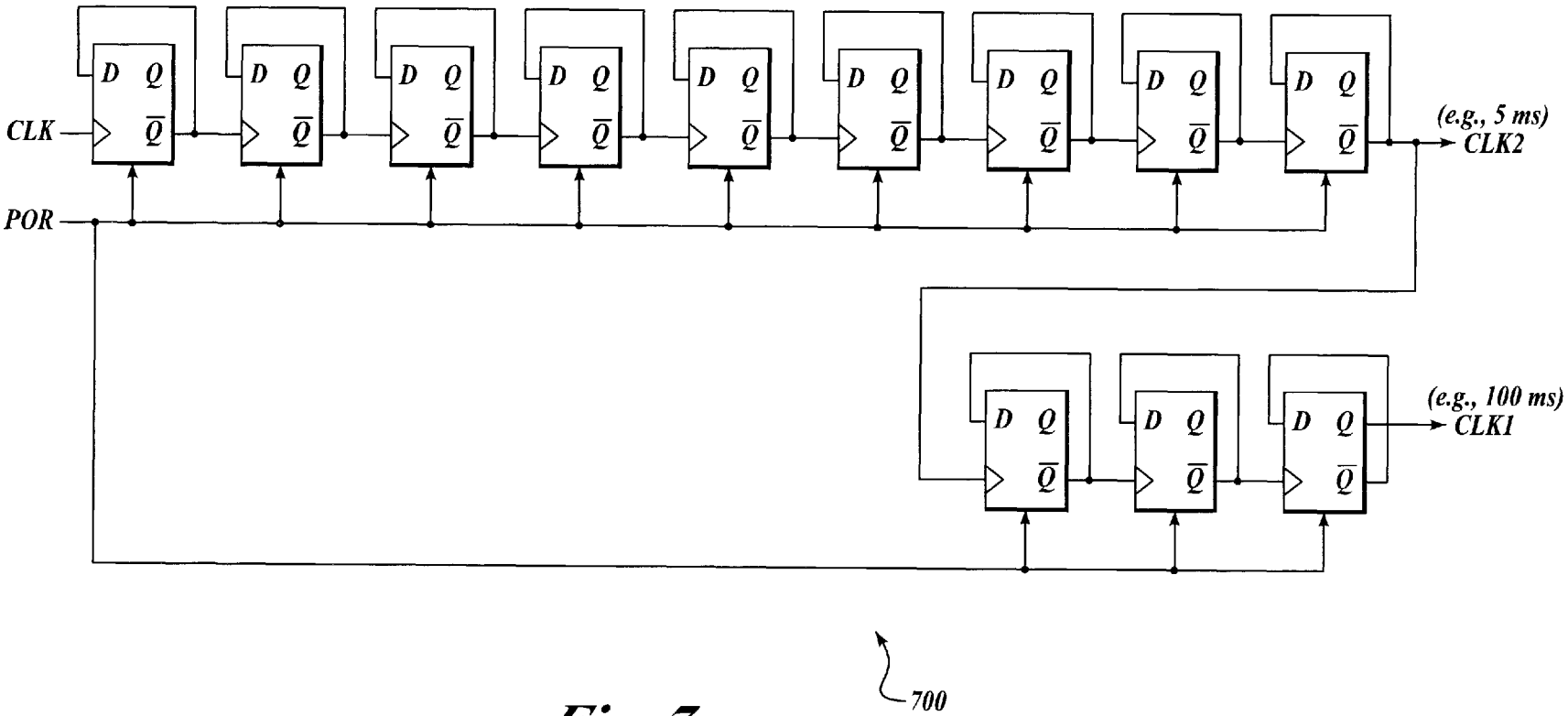
FIG. 7 is a schematic diagram illustrating a detailed example of a clock generator circuit.

FIG. 7 is a schematic diagram illustrating a detailed example of a clock generator circuit (700) that may be employed by the circuits illustrated in FIGS. 1 and 3. The clock generator circuit (500) includes twelve flip-flop circuits that are arranged to provide a divided clock signal. The CLK2 output corresponds to a division of CLK by a factor of 128, while the CLK1 output corresponds to a division of CLK by a factor of 4096. When the input signal (CLK) has a frequency of 50 kHz, CLK1 has a 5 mS pulse width and CLK2 has a 100 mS pulse width.

Figure 8:
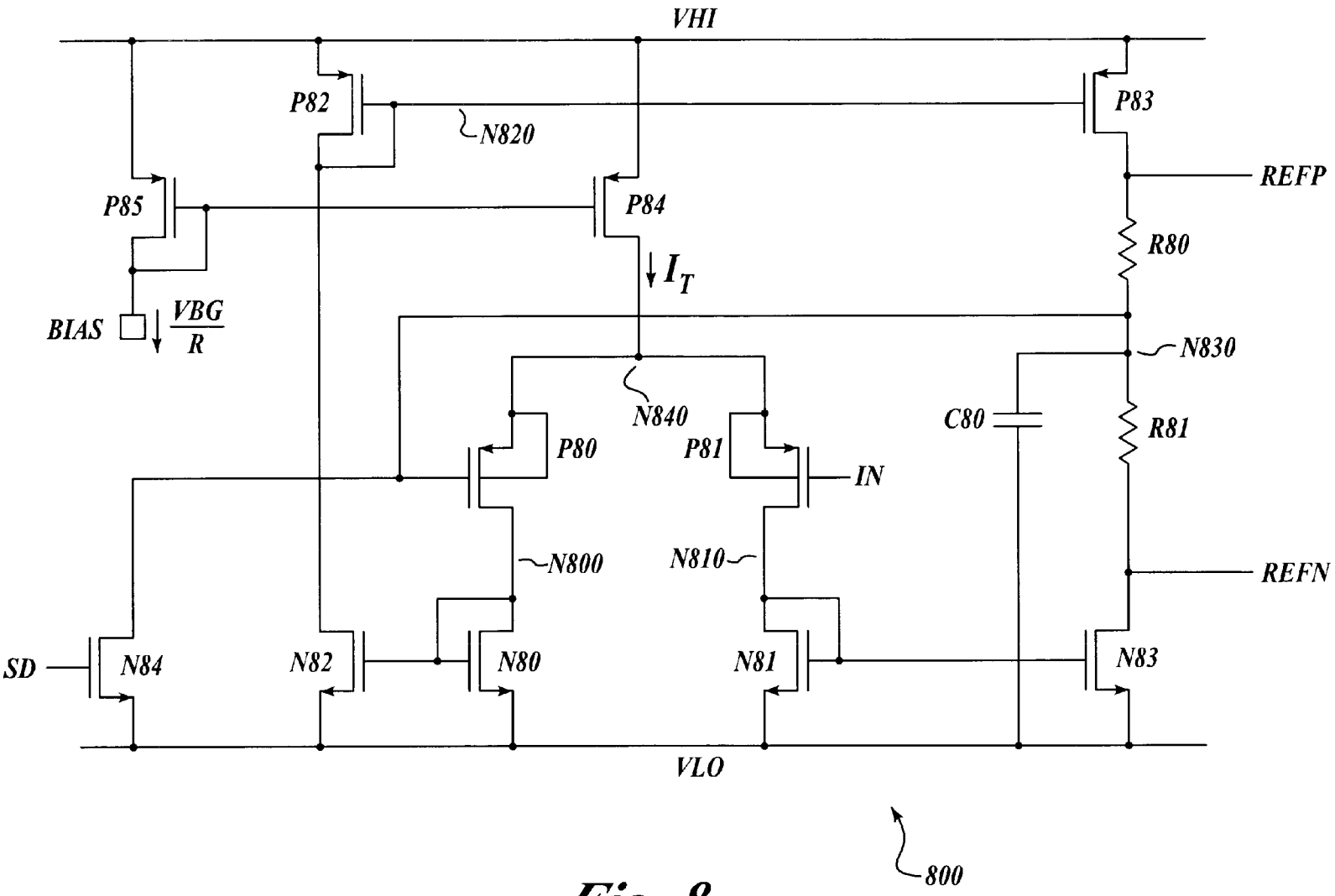
FIG. 8 is a schematic diagram illustrating a detailed example of an offset generator circuit, arranged in accordance with the present invention.

FIG. 8 is a schematic diagram illustrating a detailed example of an offset generator circuit (800) that may be employed by system 100 in FIG. 1. The offset generator circuit includes PFETs P80–P85, NFETs N80–N84, capacitor C80, and resistors R80–R81.

Transistor P80 includes a source that is coupled to node N840, a gate that is coupled to node N830, and a drain that is coupled to node N800. Transistor P81 includes a source that is coupled to node N840, a gate that is coupled to IN, and a drain that is coupled to node N810. Transistor N80 includes a source that is coupled to VLO, and a gate and drain that are coupled to node N800. Transistor N81 includes a source that is coupled to VLO, and a gate and drain that are coupled to node N810. Transistor N82 includes a source that is coupled to VLO, a gate that is coupled to node N800, and a drain that is coupled to node N820. Transistor N83 includes a source that is coupled to VLO, a gate that is coupled to node N810, and a drain that is coupled to REFN. Transistor P82 includes a source that is coupled to VHI, and a gate and drain that are coupled to node N820. Transistor P83 includes a source that is coupled to VHI, a gate that is coupled to node N820, and a drain that is coupled to REFP. Transistor P84 includes a source that is coupled to VHI, a gate that is coupled to BIAS, and a drain that is coupled to node N840. Transistor P84 includes a source that is coupled to VHI, and a gate and drain that are coupled to BIAS. Transistor N84 includes a source that is coupled to VLO, a gate that is coupled to SD, and a drain that is coupled to node N830. Capacitor C80 is coupled between node N830 and VLO. Resistor R80 is coupled between node N830 and REFP. Resistor R81 is coupled between node N830 and REFN.

In operation, offset generator circuit 800 is arranged as a unity gain amplifier that senses the voltage at node N830 and IN. Transistor P84 operates as a current source for differential pair transistors P80 and P81. Transistor pairs N80, N82; N81, N83; and P82, P83 each are arranged as current mirror circuits. Resistors R80 and R81 are arranged to generate a DC offset voltage for REFP and REFN. When resistors REFP and REFN are of equal value, the offset voltages are centered about the input signal (IN) by an equal amount (e.g., +/−100 mV).

The amplifier is preferably biased with a current that is temperature compensated. In one example, a band-gap generator circuit is employed to provide a biasing signal such that the current in the amplifier is proportional to VBG/R, where VBG is a band-gap reference voltage and resistor R is a resistor that is used in the band-gap generator circuit. Resistors R80 and R81 are manufactured using the same type of materials as resistor R. Since the resistor materials that are employed by resistors R80 and R81 are matched to resistor R, variations in the offset voltages due to processing and/or temperature variations are counteracted. Thus, values for REFP and REFN are related to the ratio of resistor values in the biasing circuit and the offset generator circuit such that the offset voltages are relatively constant.

In a conventional bypass capacitor arrangement, the resistor divider illustrated in FIG. 1 is coupled directly to a large bypass capacitor to provide filtering of supply ripple. For this example, noise is directly coupled through the resistor divider network to the capacitor, resulting in poor power supply rejection (PSRR) in a system such as an audio amplifier. The circuit arrangement in FIG. 1 isolates the divider circuit from the buffered reference voltage using a switched capacitor sampled signal from VREF. PSRR is greatly improved by isolating VREFB from VREF such that PSRRs on the order of −73 dB, for example, may be achieved. In addition, the present invention provides for elimination of the large bypass capacitor that would otherwise be required to achieve similar performance by using a switched capacitor implementation.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A switched-capacitor reference voltage circuit, comprising:

an offset generator circuit that is configured to receive an input reference voltage from an input node, wherein the offset generator circuit is configured to provide a first reference voltage at a first reference node and a second reference voltage at a second reference node;

a first switching circuit that is coupled between a first node and a second node, and includes a first control terminal that is configured to receive a first control signal;

a second switching circuit that is coupled between the second node and a third node, and includes a second control terminal that is configured to receive a second control signal;

a third switching circuit that is coupled between the input node and the second node, and includes a third control terminal that is configured to receive a third control signal;

a fourth switching circuit that is coupled between the first reference node and the first node, and includes a fourth control terminal that is configured to receive a fourth control signal;

a fifth switching circuit that is coupled between the second reference node and the first node, and includes a fifth control terminal that is configured to receive a fifth control signal;

a first capacitor circuit that is coupled to the second node;

a second capacitor circuit that is coupled to the third node; and a buffer circuit that is configured to receive a sampled signal from the third node, and arranged to provide a buffered reference signal in response to the sampled signal, whereby the sampled signal corresponds to a filtered version of the input reference voltage.

2. The switched-capacitor reference voltage circuit of claim 1, wherein the offset generator circuit is further configured such that the first reference voltage is substantially 100 mV above the input reference voltage, and the second reference voltage is substantially 100 mV below the input reference voltage.

3. The switched-capacitor reference voltage circuit of claim 1, wherein the offset generator circuit.is further configured such that the first reference voltage and the second reference voltage are compensated for at least one of process and temperature related variations in the voltages.

4. The switched-capacitor reference voltage circuit of claim 1, wherein the offset generator circuit includes a unity gain amplifier that is biased such that currents in the unity gain amplifier are proportional to VBG/R, and the unity gain amplifier is configured to provide the first and second reference voltages by driving the proportional current through resistors.

5. The switched-capacitor reference voltage circuit of claim 1, wherein the switching circuits each include a p-type FET that is configured to operate as a switching circuit, wherein each p-type FET is further arranged to minimize leakage currents.

6. The switched-capacitor reference voltage circuit of claim 1, wherein the capacitor circuits correspond to n-type FETs that are configured to operate as gate-type capacitors.

7. The switched-capacitor reference voltage circuit of claim 1, further comprising: a first capacitance value that is associated with the first capacitor circuit, and a second capacitance value that is associated with the first capacitor circuit, wherein the first capacitance value is less than the second capacitance value.

8. The switched-capacitor reference voltage circuit of claim 1, wherein the first and second capacitance circuits are on-die capacitors.

9. The switched-capacitor reference voltage circuit of claim 1, further comprising: a comparator circuit that is arranged to compare the input reference voltage to the buffered reference signal, wherein the fourth and fifth control signals are responsive to the output of the comparator circuit such that the voltage associated with the second capacitor circuit is increased when the input reference voltage is greater than the buffered reference signal, and wherein the voltage associated with the second capacitor circuit is decreased when the input reference voltage is less than the buffered reference signal.

10. The switched-capacitor reference voltage circuit of claim 1, further comprising: a comparator circuit that is arranged to compare the input reference voltage to the buffered reference signal, wherein the fourth and fifth control signals are responsive to the output of the comparator circuit.

11. The switched-capacitor reference voltage circuit of claim 1, further comprising: a divider circuit that is configured to provide the input reference signal as a division of a power-supply voltage.

12. The switched-capacitor reference voltage circuit of claim 1, further comprising: a control logic circuit that is arranged to provide the control signals such that the buffered reference signal is substantially the same as the input reference signal.

13. The switched-capacitor reference voltage circuit of claim 1, further comprising: a clock generator circuit that is configured to provide a first and second clock signal in response to an input clock signal, wherein the first clock signal is associated with a cycle time of the switched-capacitor reference voltage circuit.

14. The switched-capacitor reference voltage circuit of claim 13, further comprising: a control logic circuit that is arranged to generate pulse signals for each of the first, second, and third second control signals such that the first, second, and third switching circuits are activated at different times with respect to one another.

15. An apparatus for providing a filtered reference voltage, comprising:

a first means for storing charge that is arranged to store charge;

a second means for storing charge that is arranged to store charge;

a means for buffering that is arranged to provide a buffered reference signal in response to the charge that is stored in the second means for storing charge;

a means for comparing that is arranged to compare the buffered reference voltage and an input reference voltage;

a means for generating offset voltage that is arranged to provide a first reference voltage and a second reference voltage in response to the input reference voltage, wherein the first reference voltage is greater than the input reference voltage by a first amount, and wherein the second reference voltage is less than the input reference voltage by a second amount;

a first means for switching that is arranged to periodically couple a selected one of the first and second reference voltages to the first means for storing charge during a first time interval, wherein the selected one of the first and second reference voltages is determined by the means for comparing; and a second means for switching that is arranged to periodically couple the first means for storing charge to the second means for storing charge during a second time interval such that the charges stored in the first and second means for storing charge are redistributed during the second time interval.

16. The apparatus of claim 15, further comprising: a third means for switching that is arranged to periodically couple the input reference voltage to the first means for storing charge during a third time interval that is different from the first and second time intervals such that charge leakage effects are minimized.

17. A method for providing an output reference voltage with improved PSRR, comprising:

generating first and second reference voltages from an input reference voltage, wherein the first reference voltage is greater than the input reference voltage by a first amount, and wherein the second reference voltage is less than the input reference voltage by a second amount;

coupling the first input voltage to a first node when the output reference voltage is less than the input reference voltage by an amount;

coupling the second input voltage to the first node when the output reference voltage is greater than the input reference voltage by another amount;

storing charge associated with the voltage from the first node at a second node during a first time interval;

coupling the second node to a third node during a second time interval that is different from the first time interval;

redistributing charge during the second time interval such that the voltages associated with the second and third nodes are the same during the second time interval;

storing charge associated with the voltage associated with the third node at the end of the second time interval; and buffering the voltage at the third node to provide the output reference voltage.

18. The method from claim 17, further comprising: comparing the output reference voltage to the input reference voltage.

19. The method from claim 17, further comprising: coupling the input reference voltage to the second node during a third time interval, wherein the third time interval is different from the first and second time intervals.

20. The method of claim 19, wherein the first, second, and third time intervals are repeated at a regular interval, and wherein the third time interval is substantially longer than the first and second time intervals.

* * * * *

UNITED STATES PATENT AND TRADEMARK OFFICE

CERTIFICATE OF CORRECTION

PATENT NO. : 6,696,884 B1
DATED : February 24, 2004
INVENTOR(S) : Kazim Seven

It is certified that error appears in the above-identified patent and that said Letters Patent is hereby corrected as shown below:

Column 11,
Line 61, “circuit.is” should read -- circuit is --

Signed and Sealed this

Sixth Day of July, 2004

JON W. DUDAS
*Acting Director of the United States Patent and Trademark Office*